US009982587B2

(12) United States Patent
Hosokawa

(10) Patent No.: US 9,982,587 B2
(45) Date of Patent: May 29, 2018

(54) COOLING SYSTEM FOR ENGINE

(71) Applicant: Toyota Jidosha Kabushiki Kaisha, Toyota-shi, Aichi-ken (JP)

(72) Inventor: Yohei Hosokawa, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days. days.

(21) Appl. No.: 15/078,607

(22) Filed: Mar. 23, 2016

(65) Prior Publication Data

US 2016/0281586 A1 Sep. 29, 2016

(30) Foreign Application Priority Data

Mar. 27, 2015 (JP) ..... 2015-066902

(51) Int. Cl.
*F01P 11/16* (2006.01)

(52) U.S. Cl.
CPC ..... *F01P 11/16* (2013.01); *F01P 2025/30* (2013.01); *F01P 2025/32* (2013.01); *F01P 2031/32* (2013.01)

(58) Field of Classification Search
CPC .... F01P 11/16; F01P 2025/30; F01P 2025/32; F01P 2031/32; F01P 3/20; F01P 2003/185
See application file for complete search history.

(56) References Cited

U.S. PATENT DOCUMENTS

2002/0157620 A1* 10/2002 Kastner ..... F01P 11/14 123/41.1
2012/0137992 A1* 6/2012 Kinomuka ..... F01P 7/165 123/41.08
2015/0240702 A1 8/2015 Hosokawa

FOREIGN PATENT DOCUMENTS

| | | | |
|---|---|---|---|
| CN | 102575569 | A | 7/2012 |
| JP | 2000-303842 | A | 10/2000 |
| JP | 2005-163795 | A | 6/2005 |
| JP | 2010-007631 | A | 1/2010 |
| JP | 4883225 | B2 | 2/2012 |
| WO | 2011/042942 | A1 | 4/2011 |
| WO | 2013190619 | A1 | 12/2013 |

* cited by examiner

*Primary Examiner* — Kevin A Lathers
(74) *Attorney, Agent, or Firm* — Dinsmore & Shohl LLP

(57) ABSTRACT

A cooling system circulates a cooling medium between an engine and a radiator. The cooling system includes a determination unit. The determination unit sets a relatively small predetermined value for a threshold when a thermostat is closed, and sets a predetermined value larger than the predetermined value for the threshold when the thermostat is open. The determination unit determines that there is a stuck-closed failure in a selector valve when a temperature difference between a coolant temperature from a first coolant temperature sensor and a coolant temperature from a second coolant temperature sensor is larger than or equal to the threshold.

7 Claims, 14 Drawing Sheets

COOLING SYSTEM FOR ENGINE

CROSS-REFERENCE TO RELATED APPLICATIONS

The present application claims priority to Japanese Patent Application No. 2015-066902 filed on Mar. 27, 2015, the entire contents of which, including the specification, drawings and abstract, are incorporated herein by reference in its entirety.

BACKGROUND

1. Technical Field

The disclosure relates to a cooling system for an engine.

2. Description of Related Art

Generally, there is suggested a cooling system for an engine including a first coolant circuit, a second coolant circuit, a thermostat, a valve, a first coolant temperature sensor, a second coolant temperature sensor and an engine cooling control unit (see, for example, Japanese Patent No. 4883225). The cooling system determines whether there is a stuck-closed failure in the valve based on a temperature difference between a first coolant temperature that is detected by the first coolant temperature sensor and a second coolant temperature that is detected by the second coolant temperature sensor. The first coolant circuit includes a main path and a bypass path. The main path passes through a water pump, the engine, a radiator and the thermostat. The bypass path branches off from the main path between the engine and the radiator, passes through the valve and a heater core, and merges into the main path at the thermostat. The second coolant circuit branches off from the main path between the water pump and the engine in the main path, and merges into the bypass path between the valve and the heater core in the bypass path. The thermostat constantly permits flow of coolant from the bypass path to the water pump side of the main path, and opens or closes in response to the temperature of coolant after passage of the heater core to permit or prohibit flow of coolant from the radiator side of the main path to the water pump side of the main path. The valve is controlled by the engine cooling control unit. The first coolant temperature sensor detects the temperature of coolant inside the engine as a first coolant temperature. The second coolant temperature sensor detects the temperature of coolant flowing into the heater core as a second coolant temperature. In this cooling system for an engine, it is determined that there is a stuck-closed failure in the valve when a temperature difference between the first coolant temperature and the second coolant temperature is larger than an abnormality determination value while a command to open the valve is issued.

In the thus configured cooling system for an engine, it is conceivable that the temperature difference between the first coolant temperature and the second coolant temperature varies between when the thermostat is closed and when the thermostat is open while the valve is normally open because the amount of coolant flowing through the bypass path after passage of the engine varies. For this reason, if the threshold is set to a uniform value, it may not be possible to accurately detect a stuck-closed failure when there is actually a stuck-closed failure in the valve or erroneously detect a stuck-closed failure when there is actually no stuck-closed failure in the valve.

SUMMARY

The present disclosure provides a cooling system for an engine, which accurately determines whether there is a stuck-closed failure in a valve.

An aspect of the present disclosure provides a cooling system for an engine. The cooling system includes a first flow passage, a second flow passage, a third flow passage, a first valve, a second valve, a first temperature sensor, a second temperature sensor and a determination unit. The first flow passage is configured to circulate a cooling medium through the engine and a radiator in this order. The second flow passage is configured to communicate the first flow passage upstream of the engine with the first flow passage downstream of the radiator. The third flow passage is configured to communicate the first flow passage between the engine and the radiator with the second flow passage. The first valve is configured to open or close to permit or restrict flow of the cooling medium, which has flowed through the radiator in the first flow passage, to the first flow passage downstream of a connection portion of the first flow passage with the second flow passage. The second valve is configured to open or close to permit or restrict flow of the cooling medium, which has flowed through the engine in the first flow passage, to the second flow passage via the third flow passage. The first temperature sensor is in the first flow passage between the engine and the radiator. The second temperature sensor is installed in the second flow passage downstream of a connection portion of the second flow passage with the third flow passage. The determination unit is configured to (i) while the second valve is being controlled so as to open, when a temperature difference between a first temperature detected by the first temperature sensor and a second temperature detected by the second temperature sensor is larger than or equal to a threshold, determine that there is a stuck-closed failure in the second valve, and (ii) set the threshold such that the threshold at the time when the first valve is open is larger than the threshold at the time when the first valve is closed.

With the above-described cooling system for an engine according to the present disclosure, while the second valve is being controlled so as to open, when the temperature difference between the first temperature detected by the first temperature sensor and the second temperature detected by the second temperature sensor is larger than or equal to the threshold, it is determined that there is a stuck-closed failure in the second valve. At this time, the threshold is set such that the threshold at the time when the first valve is open is larger than the threshold at the time when the first valve is closed. The first valve opens or closes to permit or restrict flow of the cooling medium, which has flowed through the radiator in the first flow passage, to the first flow passage downstream of the connecting portion of the first flow passage with the second flow passage. The second valve opens or closes to permit or restrict flow of the cooing medium, which has flowed through the engine in the first flow passage, to the second flow passage via the third flow passage. While the second valve is open, the amount of cooling medium that has flowed through the engine in the first flow passage and that flows to the second flow passage is smaller when the first valve is open than when the first valve is closed, so the temperature difference between the first temperature and the second temperature easily increases. Therefore, by relatively reducing the threshold when the first valve is closed (reducing the threshold as compared to when the first valve is open), it is possible to further reliably detect a stuck-closed failure of the second valve when there is actually a stuck-closed failure in the second valve. By relatively increasing the threshold when the first valve is open (increasing the threshold as compared to when the first valve is closed), it is possible to suppress erroneous detection of occurrence of a stuck-closed failure in the second valve when there is actually no stuck-closed failure in the second valve. As a result of these, it is possible to further accurately determine whether there is a stuck-closed failure in the second valve. The first temperature sensor may be installed inside the engine or just downstream of the engine in the first flow passage. The second temperature sensor may be installed in the second flow passage just downstream of a connection portion of the second flow passage with the third flow passage.

In the thus configured cooling system for an engine according to the present disclosure, the first valve may be a thermostat. The determination unit may be configured to estimate whether the thermostat is open or closed based on a comparison between the first temperature and a second threshold or a comparison between the second temperature and a third threshold. With the thus configured cooling system for an engine, by using the first temperature or the second temperature, it is possible to estimate whether the thermostat is open or closed. In this case, in the cooling system for an engine, the thermostat may include a built-in heater. The determination unit may be configured to reduce the second threshold and the third threshold as an energization current of the heater increases. With the thus configured cooling system for an engine, when the thermostat includes a built-in heater, it is possible to further appropriately estimate whether the thermostat is open or closed.

In the cooling system for an engine, the first valve may be a control valve that is controlled by the determination unit to open or close. The determination unit may be configured to set the threshold such that the threshold at the time when the control valve is being controlled so as to open is larger than the threshold at the time when the control valve is not being controlled so as to open. With the thus configured cooling system for an engine, it is possible to set the threshold by determining whether the control valve is open or closed.

In the cooling system for an engine, the determination unit may be configured to set the threshold such that the threshold at the time when there is a stuck-open failure in the first valve is larger than the threshold at the time when there is no stuck-open failure in the first valve and the first valve is closed. With the thus configured cooling system for an engine, when there is a stuck-open failure in the first valve, it is possible to suppress erroneous detection of a stuck-closed failure in the second valve.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

An embodiment of the present disclosure will be described.

Figure 1:
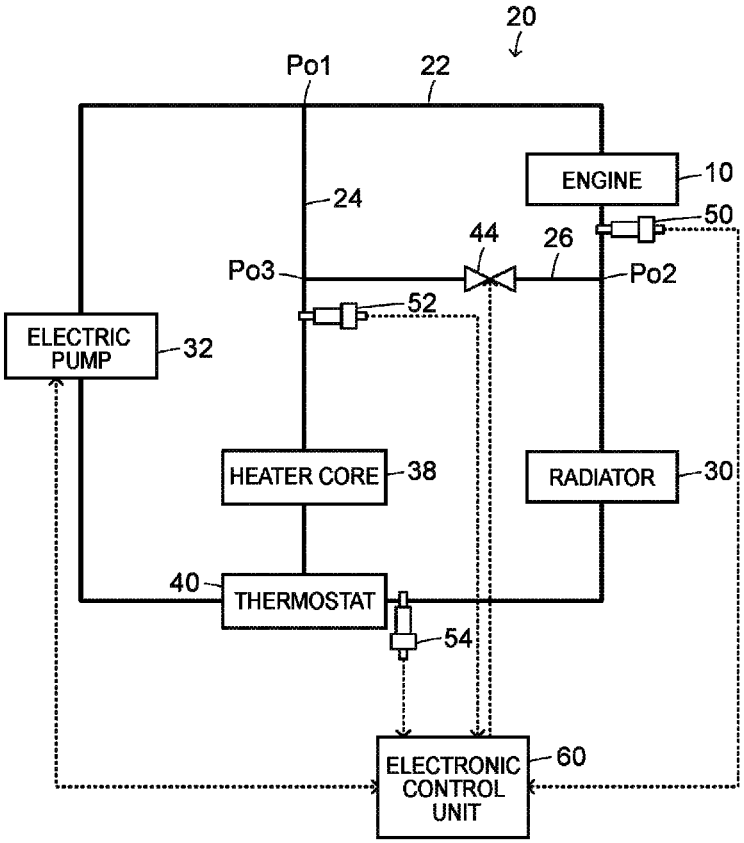
FIG. 1 is a configuration view that schematically shows the configuration of a cooling system for an engine as an example of an embodiment of the present disclosure.

FIG. 1 is a configuration view that schematically shows the configuration of a cooling system 20 for an engine as an example of the embodiment of the present disclosure. The cooling system 20 for an engine according to the embodiment is mounted on an automobile that travels by using power from an engine 10. As shown in FIG. 1, the cooling system 20 includes a circulation flow passage 22 that serves as a first flow passage, a bypass flow passage 24 that serves as a second flow passage, a communication flow passage 26 that serves as a third flow passage, a radiator 30, an electric pump 32, a thermostat 40 that serves as a first valve, a selector valve 44 that serves as a second valve, and an electronic control unit 60.

The circulation flow passage 22 is a flow passage that flows coolant (long life coolant (LLC)) in order of the electric pump 32, the engine 10, the radiator 30, the thermostat 40 and the electric pump 32. The bypass flow passage 24 is configured as a flow passage that communicates the circulation flow passage 22 at a position Po1 upstream of the engine 10 with the circulation flow passage 22 at a position (a position of the thermostat 40) downstream of the radiator 30 via a heater core 38 of an air conditioner. That is, the bypass flow passage 24 is a flow passage that bypasses the engine 10 and the radiator 30 from the position Po1 side to the thermostat 40 side and that flows coolant via the heater core 38. The communication flow passage 26 is a flow passage that communicates the circulation flow passage 22 at a position Po2 between the engine 10 and the radiator 30 with the bypass flow passage 24 at a position Po3 upstream of the heater core 38. In the embodiment, the circulation flow passage 22 and the bypass flow passage 24 are designed such that a pressure loss of the circulation flow passage 22 is smaller than a pressure loss of the bypass flow passage 24. Therefore, at the time when coolant flows through the communication flow passage 26, the coolant flows from the circulation flow passage 22 side to the bypass flow passage 24 side.

The radiator 30 exchanges heat between coolant and outside air. The electric pump 32 is installed in the circulation flow passage 22 between the thermostat 40 and the engine 10. The electric pump 32 is controlled to be driven by the electronic control unit 60, and feeds coolant under pressure.

The thermostat 40 constantly permits flow of coolant from the bypass flow passage 24 to a downstream side with respect to the thermostat 40 (electric pump 32 side) in the circulation flow passage 22, and permits or prohibits flow of coolant, which has passed through the radiator 30 in the circulation flow passage 22, to the downstream side with respect to the thermostat 40. Specifically, when the temperature of coolant that flows from the bypass flow passage 24 to the thermostat 40 is higher than or equal to a threshold Th1, the thermostat 40 opens to permit flow of coolant, which has passed through the radiator 30 in the circulation flow passage 22, to the downstream side with respect to the thermostat 40. When the temperature of coolant that flows from the bypass flow passage 24 to the thermostat 40 is lower than the threshold Th1, the thermostat 40 closes to restrict flow of coolant, which has passed through the radiator 30 in the circulation flow passage 22, to the downstream side with respect to the thermostat 40. The threshold Th1 is set to the temperature of coolant that flows from the bypass flow passage 24 to the thermostat 40 after completion of warm-up of the engine 10, and is, for example, set to 78° C., 80° C., 82° C., or the like.

The selector valve 44 is installed in the communication flow passage 26. The selector valve 44 is controlled by the electronic control unit 60 to open or close. As described above, in the embodiment, the pressure loss of the bypass flow passage 24 is larger than the pressure loss of the circulation flow passage 22. Therefore, when the selector valve 44 is open, the selector valve 44 permits at least part of coolant, which has flowed through the engine 10 in the circulation flow passage 22, to the bypass flow passage 24 via the communication flow passage 26; whereas, when the selector valve 44 is closed, the selector valve 44 restricts flow of the coolant to the bypass flow passage 24 via the communication flow passage 26.

Although not shown in the drawing, the electronic control unit 60 is configured as a microprocessor mainly including a CPU. Other than the CPU, the electronic control unit 60 includes a ROM, a RAM and input/output ports. The ROM stores processing programs. The RAM temporarily stores data. Signals from various sensors are input to the electronic control unit 60 via the input port. The signals from the various sensors include a coolant temperature Thw from a coolant temperature sensor 50, a coolant temperature Thb from a coolant temperature sensor 52, a coolant temperature Thr from a coolant temperature sensor 54, and a rotation speed Nwp of the electric pump 32 from a rotation speed sensor. The coolant temperature sensor 50 is installed in the circulation flow passage 22 between the engine 10 and the radiator 30 (for example, inside the engine 10 or a position just downstream of the engine 10). The coolant temperature sensor 50 detects the temperature of coolant. The coolant temperature sensor 52 is installed in the bypass flow passage 24 between the position Po3 and the heater core 38 (for example, a position just downstream of the position Po3). The coolant temperature sensor 52 detects the temperature of coolant. The coolant temperature sensor 54 is installed in the circulation flow passage 22 between the radiator 30 and the thermostat 40 (for example, a position just upstream of the thermostat 40). The coolant temperature sensor 54 detects the temperature of coolant. The rotation speed sensor detects the rotation speed of the electric pump 32. Various control signals are output from the electronic control unit 60 via the output port. The various control signals include a drive control signal to the selector valve 44 and a drive control signal to the electric pump 32.

In the thus configured cooling system 20 for an engine according to the embodiment, the electronic control unit 60 controls the electric pump 32 such that coolant in the circulation flow passage 22 is fed under pressure by the electric pump 32. As described above, the thermostat 40 closes when the temperature of coolant that flows from the bypass flow passage 24 to the thermostat 40 is lower than the threshold Th1, and opens when the temperature of the coolant is higher than or equal to the threshold Th1. In addition, when the coolant temperature Thw from the coolant temperature sensor 50 is lower than a threshold Th3 lower than a threshold Th2, the electronic control unit 60 controls the selector valve 44 such that the selector valve 44 closes. When the coolant temperature Thw is higher than or equal to the threshold Th3, the electronic control unit 60 controls the selector valve 44 such that the selector valve 44 opens. The threshold Th2 is the coolant temperature Thw from the coolant temperature sensor 50 at the time when the thermostat 40 switches from the closed state to the open state (at the time when the temperature of coolant that flows from the bypass flow passage 24 to the thermostat 40 changes from a state lower than the threshold Th1 to a state higher than or equal to the threshold Th1). The threshold Th2 is determined by experiment or analysis in advance, and is, for example, set to 78° C., 80° C., 82° C., or the like. The threshold Th3 is, for example, set to 58° C., 60° C., 62° C., or the like.

Figure 2:
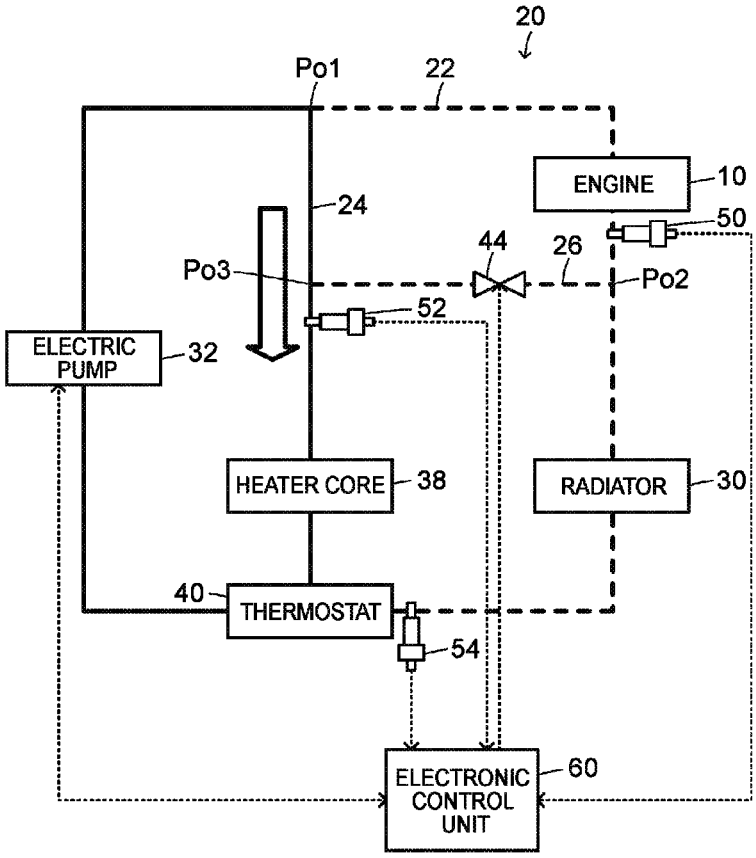
FIG. 2 is a view that illustrates a state of flow of coolant at the time when a thermostat and a selector valve are closed.
Figure 3:
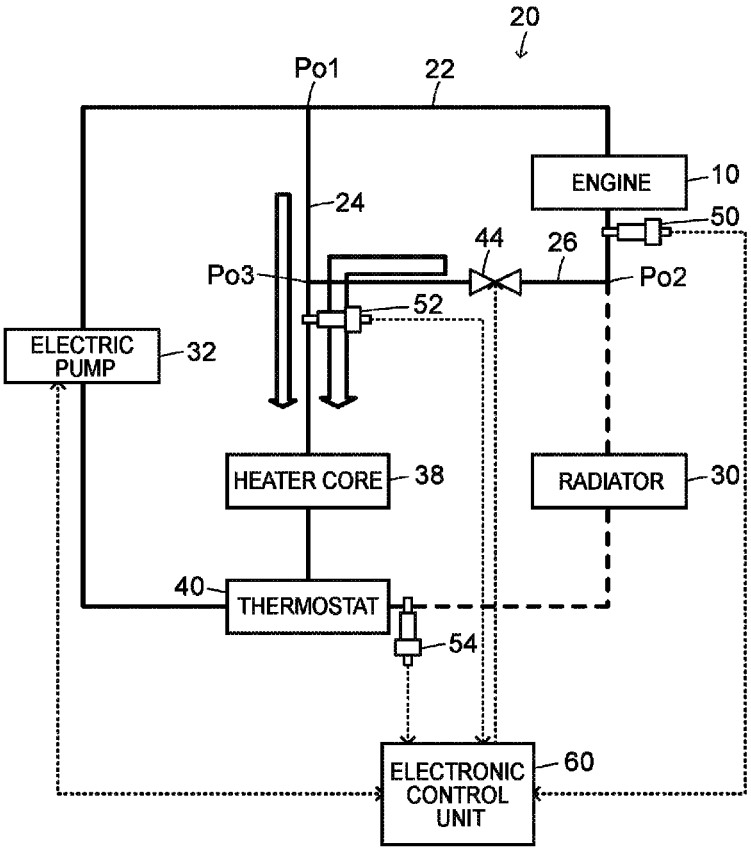
FIG. 3 is a view that illustrates a state of flow of coolant at the time when the thermostat is closed and the selector valve is open.
Figure 4:
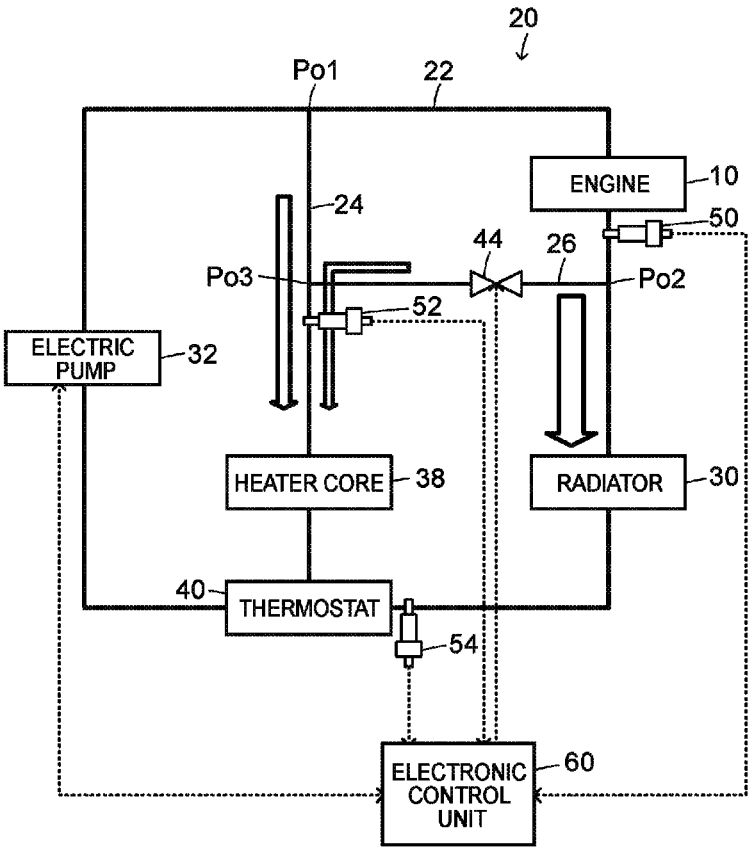
FIG. 4 is a view that illustrates a state of flow of coolant at the time when the thermostat and the selector valve are open.

FIG. 2 is a view that illustrates a state of flow of coolant at the time when the thermostat 40 and the selector valve 44 are closed. FIG. 3 is a view that illustrates a state of flow of coolant at the time when the thermostat 40 is closed and the selector valve 44 is open. FIG. 4 is a view that illustrates a state of flow of coolant at the time when the thermostat 40 and the selector valve 44 are open. In FIG. 2 to FIG. 4, the wide continuous lines indicate portions in which coolant flows among the circulation flow passage 22, the bypass flow passage 24 and the communication flow passage 26, and the wide dashed lines indicate portions in which coolant is retained among these passages. The open arrow schematically indicates the flow rate (the ratio of flow rate in FIG. 3 and FIG. 4) of coolant.

When the temperature of coolant that flows from the bypass flow passage 24 to the thermostat 40 is lower than the threshold Th1 and the coolant temperature Thw from the coolant temperature sensor 50 is lower than the threshold Th3, the thermostat 40 is closed, and the selector valve 44 is closed (kept in the closed state) by the electronic control unit 60. At this time, as shown in FIG. 2, coolant flows from the electric pump 32 to the position Po1 in the circulation flow passage 22, flows through the bypass flow passage 24, and flows from the thermostat 40 to the electric pump 32 in the circulation flow passage 22. Therefore, coolant inside the engine 10 is retained, so the temperature of coolant inside the engine 10 quickly rises as a result of warm-up operation of the engine 10. Thus, it is possible to facilitate warm-up of the engine 10. At this time, coolant inside the engine 10 is retained and coolant in the bypass flow passage 24 flows, so a temperature difference dTh between the coolant temperature Thw from the coolant temperature sensor 50 and the coolant temperature Thb from the coolant temperature sensor 52 easily increases.

When the coolant temperature Thw from the coolant temperature sensor 50 becomes higher than or equal to the threshold Th3 as a result of the warm-up operation of the engine 10, the selector valve 44 is opened. At this time, the thermostat 40 is kept in the closed state. At this time, as shown in FIG. 3, coolant not only flows in the path shown in FIG. 2 but also flows from the position Po1 to the position Po2 in the circulation flow passage 22 and through the communication flow passage 26. Therefore, coolant flows inside the engine 10 and circulates not via the radiator 30. Thus, warm-up of the engine 10 is continued. At this time, substantially the entire coolant that has flowed through the engine 10 in the circulation flow passage 22 flows to the bypass flow passage 24 via the communication flow passage 26, so the temperature difference ΔTh between the coolant temperature Thw from the coolant temperature sensor 50 and the coolant temperature Thb from the coolant temperature sensor 52 is about 0° C. to several ° C.

When the temperature of coolant that flows from the bypass flow passage 24 to the thermostat 40 becomes higher than or equal to the threshold Th1 (the coolant temperature Thw from the coolant temperature sensor 50 becomes higher than or equal to the threshold Th2) as a result of continuation of the warm-up of the engine 10, the thermostat 40 opens. When the thermostat 40 is open, coolant flows through not only the path shown in FIG. 3 but also the radiator 30 as shown in FIG. 4. Therefore, coolant that has flowed through the engine 10 is cooled by heat exchange with outside air at the radiator 30 as a result of flow of the coolant through the radiator 30, and then circulates in the circulation flow passage 22. Thus, the engine 10 is cooled. At this time, in comparison with the state where the thermostat 40 is closed and the selector valve 44 is open (the state shown in FIG. 3), the amount of coolant that flows through the communication flow passage 26 reduces, the temperature difference ΔTh between the coolant temperature Thw from the coolant temperature sensor 50 and the coolant temperature Thb from the coolant temperature sensor 52 is slightly larger than several ° C. (for example, approximately about 10° C.).

Figure 5:
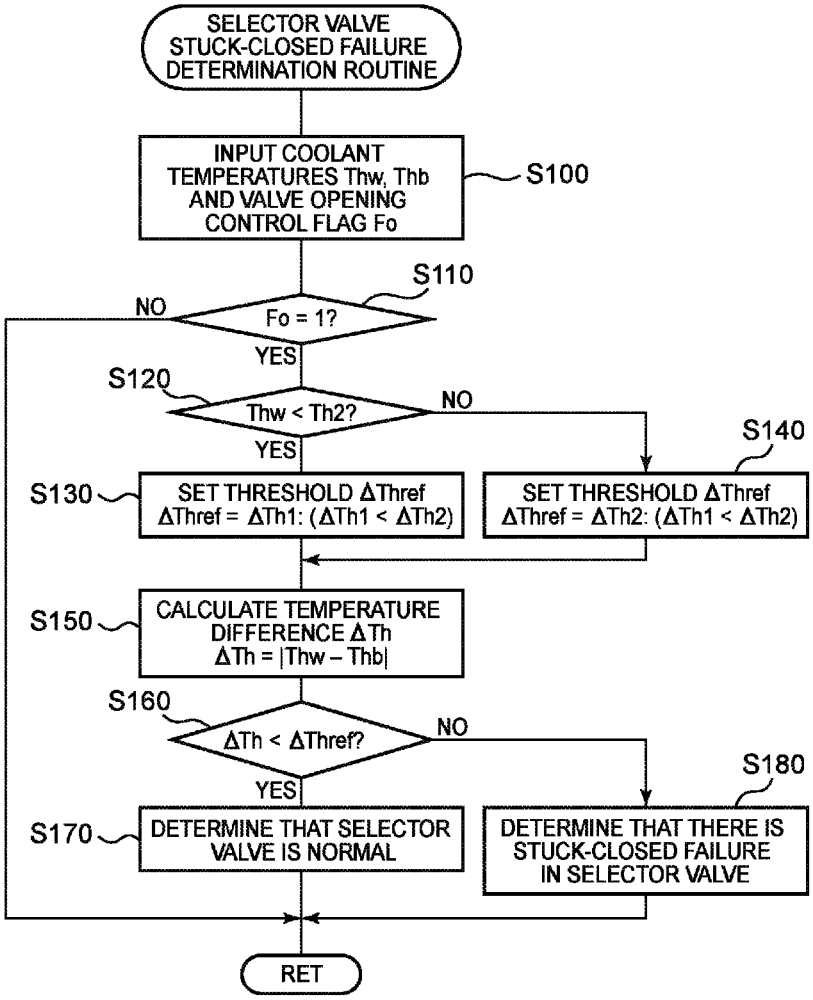
FIG. 5 is a flowchart that shows an example of a selector valve stuck-closed failure determination routine that is executed by an electronic control unit according to the embodiment.

Next, the operation of the thus configured cooling system 20 for an engine according to the embodiment, particularly, the operation at the time of determining whether there is a stuck-closed failure in the selector valve 44, will be described. FIG. 5 is a flowchart that shows an example of a selector valve stuck-closed failure determination routine that is executed by the electronic control unit 60 according to the embodiment. This routine is repeatedly executed.

When the selector valve stuck-closed failure determination routine is executed, the electronic control unit 60 initially receives data, such as the coolant temperatures Thw, Thb, and a valve opening control flag Fo (step S100). A value detected by the coolant temperature sensor 50 is input as the coolant temperature Thw. A value detected by the coolant temperature sensor 52 is input as the coolant temperature Thb. The valve opening control flag Fo set to a value of 1 is loaded and input when control for controlling the selector valve 44 such that the selector valve 44 opens (hereinafter, referred to as valve opening control over the selector valve 44) is being executed; whereas the valve opening control flag Fo set to a value of 0 is loaded and input when valve opening control over the selector valve 44 is not being executed.

When data are input in this way, the value of the valve opening control flag Fo is investigated (step S110). When the valve opening control flag Fo is a value of 0, it is determined that valve opening control over the selector valve 44 is not being executed, and the routine is ended.

When the valve opening control flag Fo is a value of 1, it is determined that valve opening control over the selector valve 44 is being executed, and the coolant temperature Thw is compared with the above-described threshold Th2 (step S120). When the coolant temperature Thw is lower than the threshold Th2, it is determined (estimated) that the thermostat 40 is closed, and a predetermined value ΔTh1 is set for the threshold ΔThref (step S130). The threshold ΔThref is a threshold that is used to determine whether there is a stuck-closed failure in the selector valve 44. The predetermined value ΔTh1 may be, for example, set to 5° C., 6° C., 7° C., or the like.

When the threshold ΔThref is set in this way, a difference between the coolant temperature Thw and the coolant temperature Thb is calculated as the temperature difference ΔTh (step S150), and the calculated temperature difference ΔTh is compared with the threshold ΔThref (step S160). When the temperature difference ΔTh is smaller than the threshold ΔThref, it is determined that there is no stuck-closed failure in the selector valve 44, that is, it is determined that the selector valve 44 is normal (step S170), and the routine is ended. On the other hand, when the temperature difference ΔTh is higher than or equal to the threshold ΔThref, it is determined that there is a stuck-closed failure in the selector valve 44 (step S180), and the routine is ended.

When the coolant temperature Thw is higher than or equal to the threshold Th2 in step S120, it is determined (estimated) that the thermostat 40 is open, a predetermined value ΔTh2 larger than the predetermined value ΔTh1 is set for the threshold ΔThref (step S140), and the process from step S150 is executed. The predetermined value ΔTh2 may be, for example, set to 15° C., 16° C., 17° C., or the like.

As described above, the temperature difference ΔTh more easily increases when the thermostat 40 is open than when the thermostat 40 is closed. Therefore, when the threshold ΔThref is set to a relatively small constant value, there is a possibility that a stuck-closed failure of the selector valve 44 is erroneously detected when the thermostat 40 is open. In contrast, when the threshold ΔThref is set to a relatively large constant value, there is a possibility that a stuck-closed failure of the selector valve 44 is not sufficiently detected. In the present embodiment, in consideration of these possibilities, when the thermostat 40 is closed, the relatively small predetermined value ΔTh1 is set for the threshold ΔThref; whereas, when the thermostat 40 is open, the predetermined value ΔTh2 larger than the predetermined value ΔTh1 is set for the threshold ΔThref. Thus, it is possible to further reliably detect a stuck-closed failure of the selector valve 44 when the thermostat 40 is closed, and it is possible to suppress erroneous detection of a stuck-closed failure of the selector valve 44 when the thermostat 40 is open. As a result, it is possible to further accurately determine whether there is a stuck-closed failure in the selector valve 44.

In the above-described cooling system 20 for an engine according to the embodiment, when the temperature difference ΔTh between the coolant temperature Thw from the coolant temperature sensor 50 and the coolant temperature Thb from the coolant temperature sensor 52 is larger than or equal to the threshold ΔThref, it is determined that there is a stuck-closed failure in the selector valve 44. At this time, when the thermostat 40 is closed, the relatively small predetermined value ΔTh1 is set for the threshold ΔThref; whereas, when the thermostat 40 is open, the predetermined value ΔTh2 larger than the predetermined value ΔTh1 is set for the threshold ΔThref. Thus, it is possible to further reliably detect a stuck-closed failure of the selector valve 44 when the thermostat 40 is closed, and it is possible to suppress erroneous detection of a stuck-closed failure of the selector valve 44 when the thermostat 40 is open. As a result, it is possible to further accurately determine whether there is a stuck-closed failure in the selector valve 44.

In the cooling system 20 for an engine according to the embodiment, it is determined (estimated) whether the thermostat 40 is closed or open based on a comparison between the coolant temperature Thw from the coolant temperature sensor 50 and the threshold Th2. Instead, it may be determined (estimated) whether the thermostat 40 is closed or open based on a comparison between the coolant temperature Thb from the coolant temperature sensor 52 and a threshold Th2*b*. The threshold Th2*b* is the coolant temperature Thw from the coolant temperature sensor 52 at the time when the thermostat 40 switches from the closed state to the open state. The threshold Th2*b* is determined by experiment or analysis in advance, and is, for example, set to 78° C., 80° C., 82° C., or the like. It may be determined (estimated) whether the thermostat 40 is closed or open based on a comparison between the coolant temperature Thr from the coolant temperature sensor 54 and a threshold Th2*c*. The threshold Th2*c* is the coolant temperature Thr from the coolant temperature sensor 54, at which it is allowed to be determined that the thermostat 40 has switched from the closed state to the open state. The threshold Th2*c* is determined by experiment or analysis in advance, and is, for example, set to 78° C., 80° C., 82° C., or the like. When the thermostat 40 is closed, coolant in a portion from the position Po2 to the thermostat 40 in the circulation flow passage 22 is retained, the coolant temperature Thr does not rise so much; whereas, when the thermostat 40 opens, coolant flows from the position Po2 to the thermostat 40 in the circulation flow passage 22, and the coolant temperature Thr rises. Therefore, the coolant temperature Thr becomes higher than or equal to the threshold Th2*c* after a lapse of a certain time from when the thermostat 40 actually opens, and it is determined (estimated) that the thermostat 40 is open.

Figure 6:
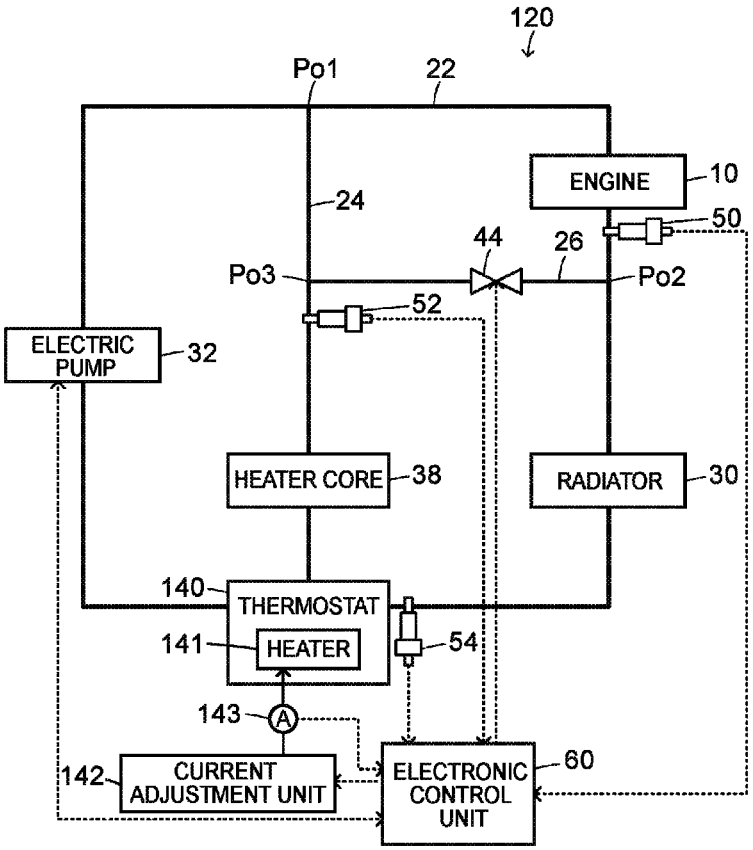
FIG. 6 is a configuration view that schematically shows the configuration of a cooling system for an engine according to a first alternative embodiment to the embodiment.

Next, a first alternative embodiment to the present embodiment will be described. In the cooling system 20 for an engine according to the above embodiment, when the temperature of coolant that flows from the bypass flow passage 24 to the thermostat 40 is higher than or equal to the threshold Th1, the thermostat 40 opens to permit flow of coolant, which has passed through the radiator 30 in the circulation flow passage 22, to the downstream side with respect to the thermostat 40; whereas, when the temperature of coolant that flows from the bypass flow passage 24 to the thermostat 40 is lower than the threshold Th1, the thermostat 40 closes to restrict flow of coolant, which has passed through the radiator 30 in the circulation flow passage 22, to the downstream side with respect to the thermostat 40. However, as shown by a cooling system 120 for an engine according to the alternative embodiment shown in FIG. 6, a thermostat 140 includes a built-in heater 141, and further includes a current adjustment unit 142 that adjusts a current (electric power) that is supplied to the heater 141. The cooling system 120 is the same as the cooling system 20 shown in FIG. 1 except the thermostat 140, the heater 141, and the current adjustment unit 142. Therefore, like reference numerals denote the same portions, and the detailed description thereof is omitted.

The thermostat 140 is configured such that an open/close threshold Th4 reduces from the threshold Th1 as an energization current It that is supplied to the heater 141 increases. The current adjustment unit 142 is controlled by the electronic control unit 60, and adjusts current by which the heater 141 is energized (not shown) from a battery (not shown). Not only the signals similar to those of the cooling system 20 shown in FIG. 1 but also, for example, the energization current It of the heater 141 from the current sensor 143 installed in a power line that connects the current adjustment unit 142 with the heater 141 is input to the electronic control unit 60 via the input port. Not only the signals similar to those of the cooling system 20 shown in FIG. 1 but also a drive control signal to the current adjustment unit 142, or the like, is output from the electronic control unit 60 via the output port.

Figure 7:
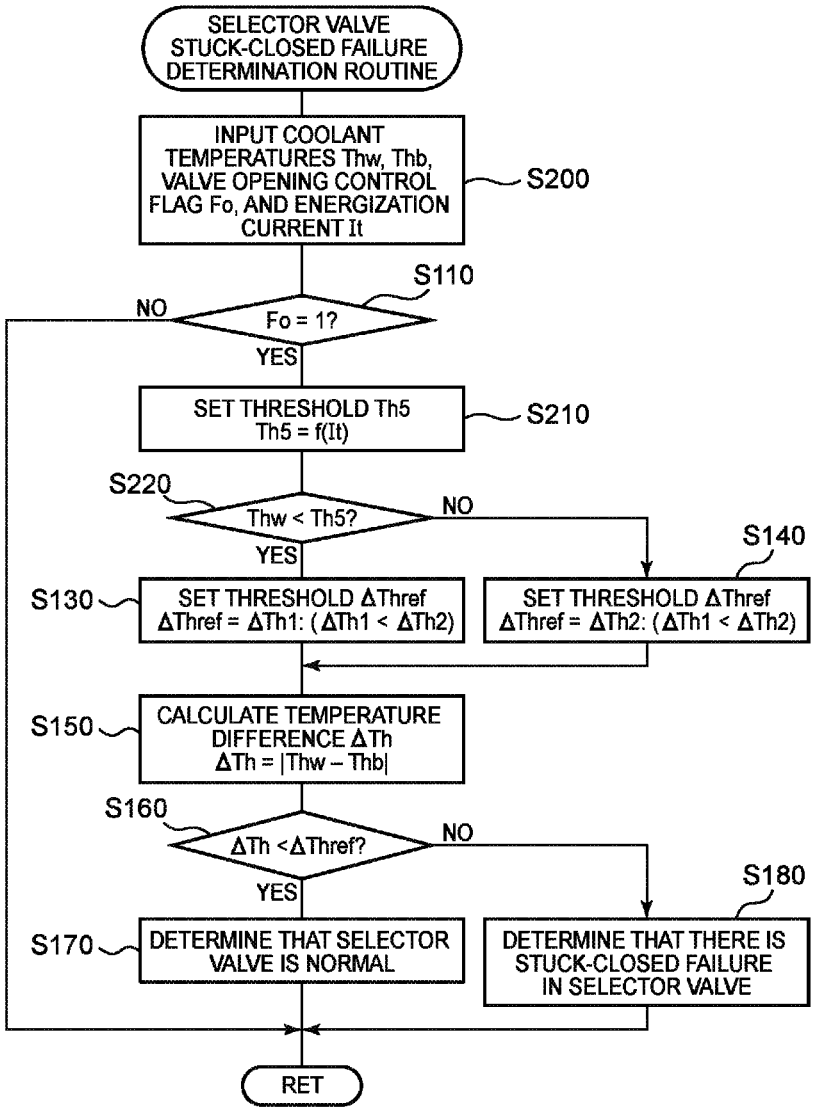
FIG. 7 is a flowchart that shows an example of a selector valve stuck-closed failure determination routine according to the first alternative embodiment.

In the cooling system 120 for an engine, the electronic control unit 60 executes a selector valve stuck-closed failure determination routine shown in FIG. 7 instead of the selector valve stuck-closed failure determination routine shown in FIG. 5. The routine shown in FIG. 7 is the same as the routine shown in FIG. 5 except that the process of step S200 is executed instead of the process of step S100 and the processes of step S210 and step S220 are executed instead of the process of step S120 Therefore, like step numbers denote the same processes, and the detailed description thereof is omitted.

When the selector valve stuck-closed failure determination routine shown in FIG. 7 is executed, the electronic control unit 60 initially receives the coolant temperatures Thw, Thb and the valve opening control flag Fo as in the case of the process of step S100 of the routine shown in FIG. 5, and receives the energization current It of the heater 141 of the thermostat 140 (step S200). A value detected by a current sensor 143 is input as the energization current It of the heater 141 of the thermostat 140.

When data are input in this way, the value of the valve opening control flag Fo is investigated (step S110). When the valve opening control flag Fo is a value of 1, it is determined that valve opening control over the selector valve 44 is being executed, and a threshold Th5 is set based on the energization current It of the heater 141 (step S210), and then the coolant temperature Thw is compared with the threshold Th5 (step S220). When the coolant temperature Thw is lower than the threshold Th5, the predetermined value ΔTh1 is set for the threshold ΔThref (step S130), and the process from step S150 is executed; whereas, when the coolant temperature Thw is higher than or equal to the threshold Th5, the predetermined value ΔTh2 is set for the threshold ΔThref (step S140), and the process from step S150 is executed.

Figure 8:
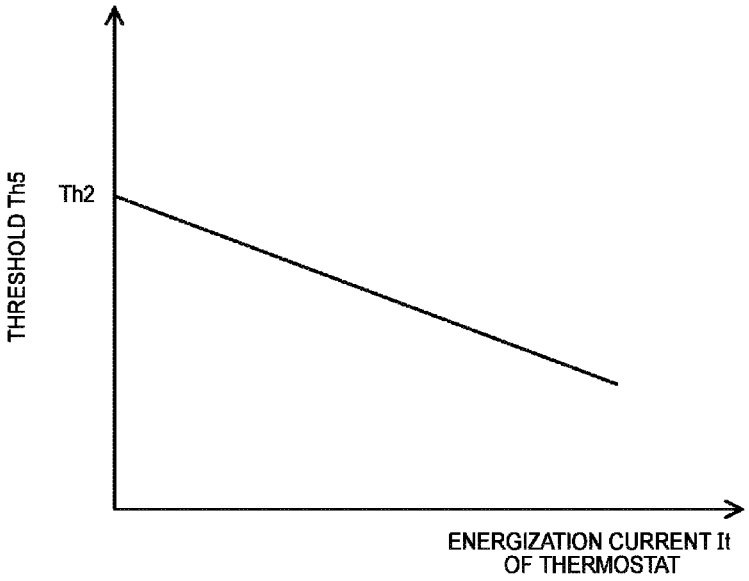
FIG. 8 is a graph that illustrates an example of the relationship between an energization current of a heater and a threshold in the first alternative embodiment.

The threshold Th5 is a threshold that is used to determine (estimate) whether the thermostat 140 is open or closed. In the present first alternative embodiment, the relationship between the energization current It of the heater 141 and the threshold Th5 is determined in advance as a map and is stored in the ROM (not shown). When the energization current It of the heater 141 is given, the corresponding threshold Th5 is derived from the map and set. FIG. 8 shows an example of the relationship between the energization current It of the heater 141 and the threshold Th5. As shown in FIG. 8, the threshold Th5 is set so as to tend to decrease from the above-described value Th2 as the energization current It of the heater 141 increases. This is based on the fact that the open/close threshold Th4 of the thermostat 140 is configured to decrease from the threshold Th1 as the energization current It increases. This threshold Th5 is determined by experiment or analysis in advance as the coolant temperature Thw from the coolant temperature sensor 50 at the time when the thermostat 140 switches from the closed state to the open state (at the time when the temperature of coolant that flows from the bypass flow passage 24 to the thermostat 140 changes from a state lower than the threshold Th4 to a state higher than or equal to the threshold Th4) for each energization current It.

When it is possible to change the threshold for opening or closing the thermostat 140 by setting the threshold ΔThref in response to the magnitude relation between the thus determined threshold Th5 and the coolant temperature Thw, it is possible to further appropriately set the threshold ΔThref.

In this alternative embodiment, it is determined (estimated) whether the thermostat 140 is open or closed based on a comparison between the coolant temperature Thw from the temperature sensor 50 and the threshold Th5 commensurate with the energization current It of the heater 141. However, it may be determined (estimated) whether the thermostat 140 is closed or open based on a comparison between the coolant temperature Thb from the coolant temperature sensor 52 and the threshold Th5*b*. The threshold Th5*b* is the coolant temperature Thw from the coolant temperature sensor 52 at the time when the thermostat 140 switches from the closed state to the open state. The threshold Th5*b* is determined by experiment or analysis in advance, and is, for example, set to a value similar to the threshold Th5 (a value commensurate with the energization current It of the heater 141), or the like. It may be determined (estimated) whether the thermostat 140 is closed or open based on a comparison between the coolant temperature Thr from the coolant temperature sensor 54 and the threshold Th5*c*. The threshold Th5*c* is the coolant temperature Thr from the coolant temperature sensor 54 at which it is allowed to be determined that the thermostat 140 has switched from the closed state to the open state. The threshold Th5*c* is determined by experiment or analysis in advance, and is, for example, set to a value similar to the threshold Th5 (a value commensurate with the energization current It of the heater 141), or the like. As described above, when the thermostat 140 is closed, the coolant temperature Thr does not rise so much; whereas, when the thermostat 140 is open, the coolant temperature Thr rises. Therefore, the coolant temperature Thr becomes higher than or equal to the threshold Th5*c* after a lapse of a certain period of time from when the thermostat 140 actually opens, and it is determined (estimated) that the thermostat 140 is open.

Figure 9:
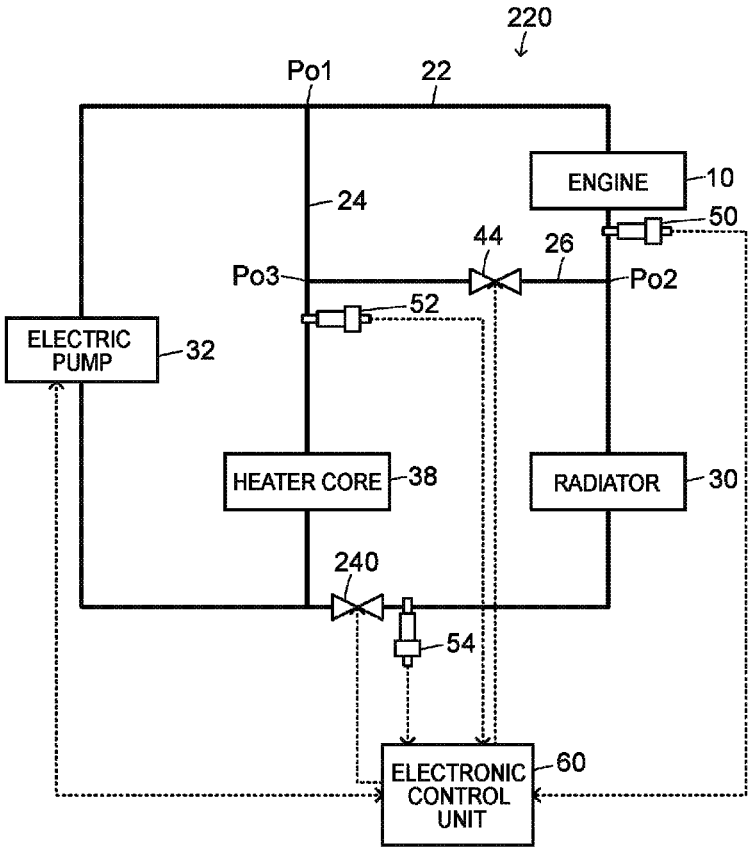
FIG. 9 is a configuration view that schematically shows the configuration of a cooling system for an engine according to a second alternative embodiment to the embodiment.

Next, a second alternative embodiment of the present embodiment will be described. In the cooling system 20 for an engine according to the above-described embodiment, the thermostat 40 that permits or restricts flow of coolant, which has passed through the radiator 30 in the circulation flow passage 22, is provided. However, instead of the thermostat 40, as shown by a cooling system 220 for an engine according to the alternative embodiment shown in FIG. 9, a selector valve 240 that is controlled by the electronic control unit 60 to open or close may be provided. This cooling system 220 is the same as the cooling system 20 shown in FIG. 1 except that the selector valve 240 is provided instead of the thermostat 40. Therefore, like reference numerals denote the same portions, and the detailed description thereof is omitted.

When the selector valve 240 is open, the selector valve 240 permits flow of coolant, which has passed through the radiator 30 of the circulation flow passage 22, to the downstream side with respect to the thermostat 40; whereas, when the selector valve 240 is closed, the selector valve 240 restricts flow of coolant, which has passed through the radiator 30 in the circulation flow passage 22, to the downstream side with respect to the thermostat 40. Not only the signals similar to those of the cooling system 20 shown in FIG. 1 but also a drive control signal to the selector valve 240, or the like, is output from the electronic control unit 60 via the output port.

Figure 10:
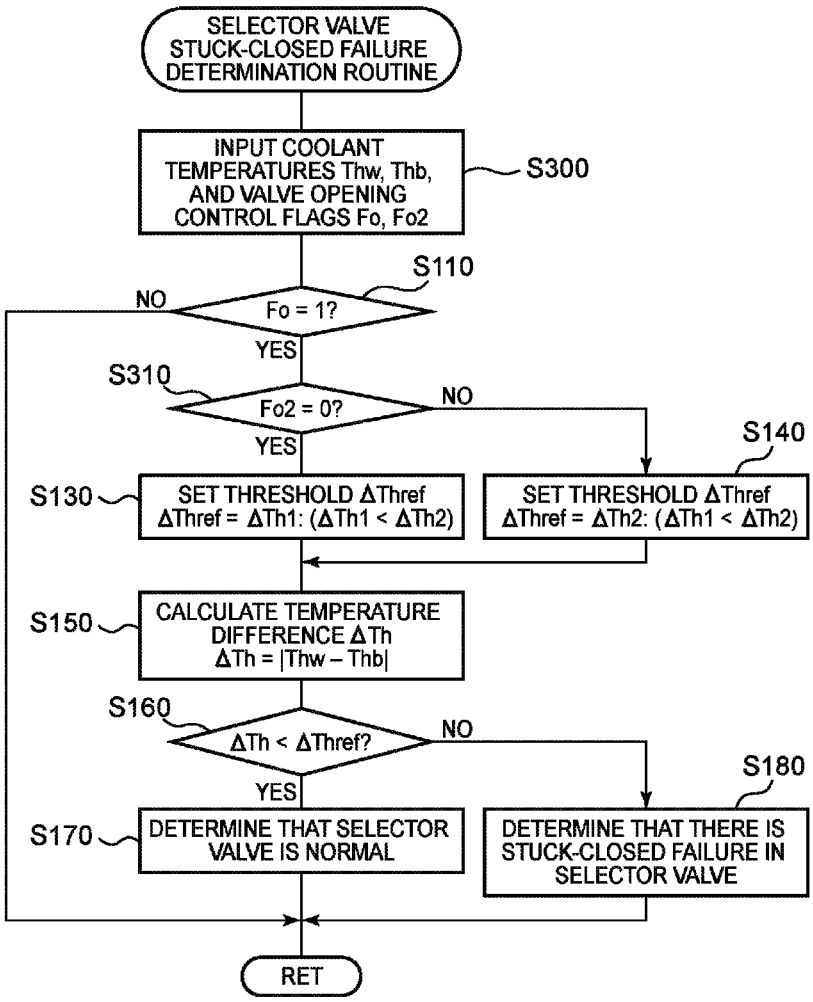
FIG. 10 is a flowchart that shows an example of a selector valve stuck-closed failure determination routine according to the second alternative embodiment.

In the cooling system 220 for an engine, the electronic control unit 60 executes a selector valve stuck-closed failure determination routine shown in FIG. 10 instead of the selector valve stuck-closed failure determination routine shown in FIG. 5. The routine shown in FIG. 10 is the same as the routine shown in FIG. 5 except that the processes of step S300 and step S310 are executed instead of the processes of step S100 and step S120. Therefore, like step numbers denote the same processes, and the detailed description thereof is omitted.

When the selector valve stuck-closed failure determination routine shown in FIG. 10 is executed, the electronic control unit 60 initially receives the coolant temperatures Thw, Thb and the valve opening control flag Fo as in the case of the process of step S100 of the routine shown in FIG. 5, and receives a valve opening control flag Fo2 (step S300). The valve opening control flag Fo2 set to a value of 1 is loaded and input when control for controlling the selector valve 240 such that the selector valve 240 opens (hereinafter, referred to as valve opening control over the selector valve 240) is being executed; whereas the valve opening control flag Fo2 set to a value of 0 is loaded and input when valve opening control over the selector valve 240 is not being executed.

When data are input in this way, the value of the valve opening control flag Fo is investigated (step S110). When the valve opening control flag Fo is a value of 1, it is determined that valve opening control over the selector valve 44 is being executed, and the value of the valve opening control flag Fo2 is investigated (step S310). When the valve opening control flag Fo2 is a value of 0, it is determined that valve opening control over the selector valve 240 is not being executed, the predetermined value ΔTh2 is set for the threshold ΔThref (step S130), and the process from step S150 is executed. When the valve opening control flag Fo2 is a value of 1, it is determined that valve opening control over the selector valve 240 is being executed, the predetermined value ΔTh2 is set for the threshold ΔThref (step S140), and the process from step S150 is executed.

In this case, the threshold ΔThref is set in response to whether valve opening control over the selector valve 240 is being executed, in other words, whether the selector valve 240 is open or closed, so similar advantageous effects to those of the above-described embodiment are obtained.

Figure 11:
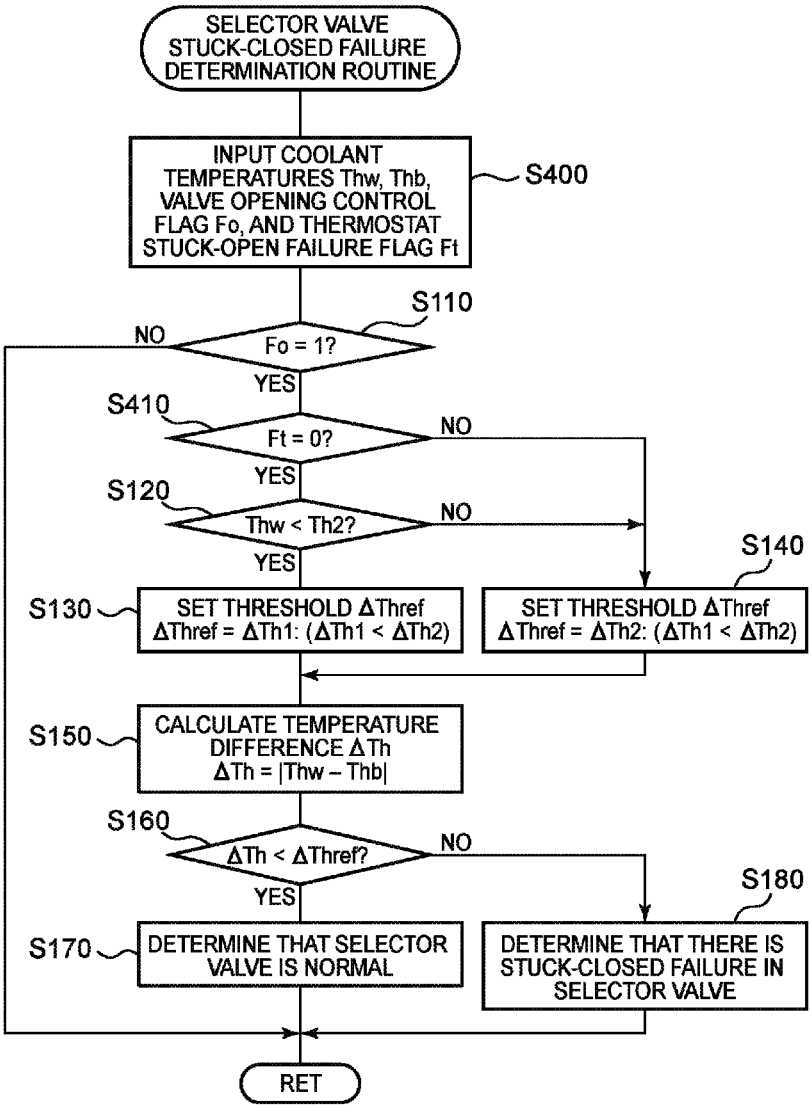
FIG. 11 is a flowchart that shows an example of a selector valve stuck-closed failure determination routine according to a third alternative embodiment to the embodiment.

Next, a third alternative embodiment to the present embodiment will be described. In the cooling system 20 for an engine according to the above embodiment, the threshold ΔThref is set in response to the magnitude relation between the coolant temperature Thw from the coolant temperature sensor 50 and the threshold Th2. Instead, the threshold ΔThref may be set in response to the magnitude relation between the coolant temperature Thw from the coolant temperature sensor 50 and the threshold Th2 and whether the thermostat 40 is normal. FIG. 11 shows an example of a selector valve failure determination routine in this case. The routine shown in FIG. 11 is the same as the routine shown in FIG. 5 except that the process of step S400 is executed instead of the process of step S100, the process of step S410 is added between the process of step S110 and the process of step S120. Like step numbers denote the same processes of the routine shown in FIG. 11 to those of the routine shown in FIG. 5, and the detailed description thereof is omitted.

When the selector valve stuck-closed failure determination routine shown in FIG. 11 is executed, the electronic control unit 60 initially receives the coolant temperatures Thw, Thb and the valve opening control flag Fo as in the case of the process of step S100 of the routine shown in FIG. 5, and receives a thermostat stuck-open failure flag Ft (step S400). The thermostat stuck-open failure flag Ft set to a value of 0 is loaded and input when there is no stuck-open failure in the thermostat 40; whereas the thermostat stuck-open failure flag Ft set to a value of 1 is loaded and input when there is a stuck-open failure in the thermostat 40. Whether there is a stuck-open failure in the thermostat 40 may be, for example, determined based on, for example, a state of changes in the coolant temperature Thw from the coolant temperature sensor 50 and the coolant temperature Thr from the coolant temperature sensor 54 while the engine 10 is being warmed up. Now it is assumed that the selector valve 44 is open and the engine 10 is being warmed up. When the thermostat 40 is normally closed, coolant in a portion from the position Po2 to the thermostat 40 in the circulation flow passage 22 is retained. Therefore, the coolant temperature Thw rises, but the coolant temperature Thr does not rise so much. In contrast, when there is a stuck-open failure in the thermostat 40, coolant flows through the portion from the position Po2 to the thermostat 40 in the circulation flow passage 22, so the coolant temperature Thw gently rises, and the coolant temperature Thr rises accordingly. Therefore, when this phenomenon is utilized, it is possible to determine whether there is a stuck-open failure in the thermostat 40. Of course, it may also be determined whether there is a stuck-open failure in the thermostat 40 by using only the coolant temperature Thw or only the coolant temperature Thr or it may be determined whether there is a stuck-open failure in the thermostat 40 by using another factor, such as a time that is taken until warm-up of the engine 10 completes.

When data are input in this way, the value of the valve opening control flag Fo is investigated (step S110). When the valve opening control flag Fo is a value of 1, it is determined that valve opening control over the selector valve 44 is being executed, and the value of the thermostat stuck-open failure flag Ft is investigated (step S410). When the thermostat stuck-open failure flag Ft is a value of 0, it is determined that there is no stuck-open failure in the thermostat 40, the threshold ΔThref is set in response to the magnitude relation between the coolant temperature Thw and the threshold Th2 (step S120, step S130, step S140), and then the process from step S150 is executed.

When the thermostat stuck-open failure flag Ft is a value of 1 in step S410, it is determined that there is a stuck-open failure in the thermostat 40, the predetermined value ΔTh2 is set to the threshold ΔThref (step S140) irrespective of the coolant temperature Thw, and then the process from step S150 is executed.

In this way, when there is a stuck-open failure in the thermostat 40, the predetermined value ΔTh2 is set for the threshold ΔThref irrespective of the coolant temperature Thw, and it is determined whether there is a stuck-closed failure in the selector valve 44 based on a comparison between the temperature difference ΔTh and the threshold ΔThref. Thus, it is possible to suppress erroneous detection of a stuck-closed failure of the selector valve 44.

In the cooling system 20 for an engine according to the above-described embodiment, when the coolant temperature Thw from the coolant temperature sensor 50 is higher than or equal to the threshold Th2, the predetermined value ΔTh2 is set for the threshold ΔThref. However, the threshold ΔThref may be set in response to a heat radiation amount Qdr of coolant at the radiator 30, the temperature difference ΔThe of coolant in the circulation flow passage 22 before and after flowing through the engine 10, a heat radiation amount Qdh of coolant at the heater core 38 in the bypass flow passage 24, and the like. Hereinafter, this will be sequentially described.

Figure 12:
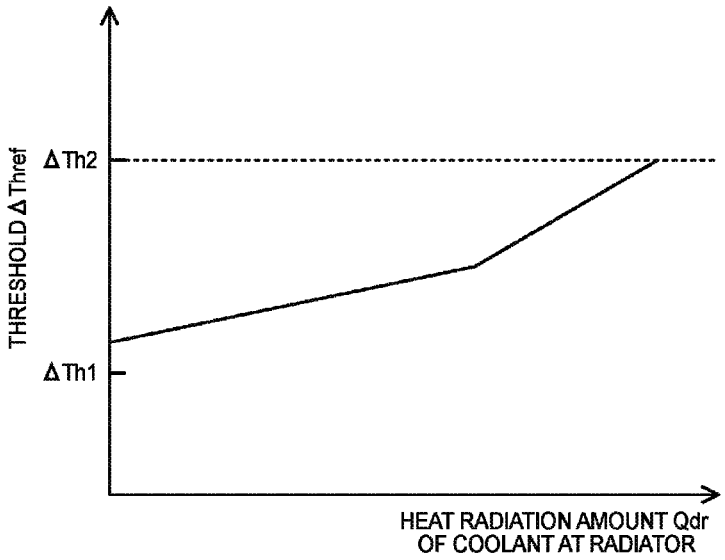
FIG. 12 is a graph that illustrates an example of the relationship between a heat radiation amount of coolant in the radiator and a threshold.

FIG. 12 is a graph that illustrates an example of the relationship between the heat radiation amount Qdr of coolant at the radiator 30 and the threshold ΔThref. In the example shown in FIG. 12, the threshold ΔThref is set so as to tend to increase as the heat radiation amount Qdr of coolant at the radiator 30 increases within the range larger than the above-described threshold ΔTh1 and smaller than or equal to the above-described threshold ΔTh2. This is based on the reason why, when the thermostat 40 is open, as the heat radiation amount Qdr of coolant at the radiator 30 increases, the coolant temperature Thb that is detected by the coolant temperature sensor 52 easily decreases, and the temperature difference ΔTh at the time when the selector valve 44 is normally open easily increases. As for the abscissa axis of FIG. 12, the heat radiation amount Qdr of coolant at the radiator 30 may be used, or a parameter related to the heat radiation amount Qdr, such as a vehicle speed of an automobile on which the cooling system 20 for an engine is mounted, the temperature of air before flowing through the radiator 30 (for example, outside air temperature, the intake air temperature of the engine 10, or the like), the rotation speed of a fan installed in the radiator 30, and the opening degree of a grill shutter installed at the front face of an automobile, may be used. It is presumable that the heat radiation amount Qdr increases as the vehicle speed increases, increases as the temperature of air before flowing through the radiator 30 decreases, increases as the rotation speed of the fan increases, and increases as the opening degree of the grill shutter increases.

Figure 13:
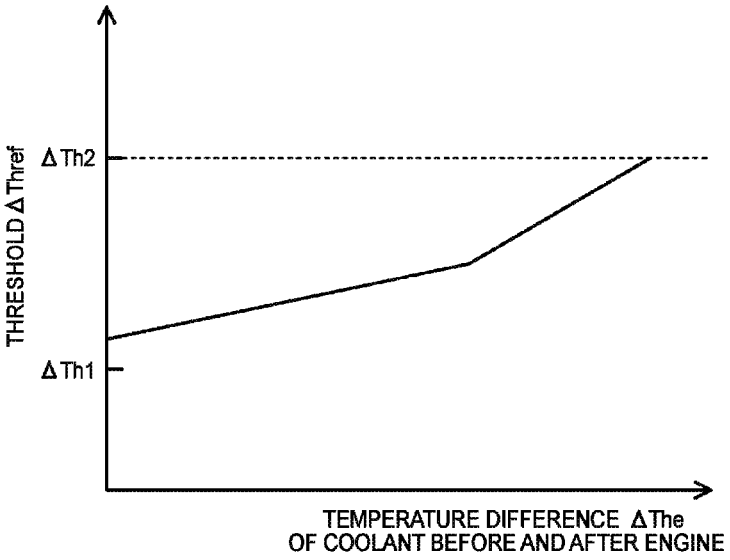
FIG. 13 is a graph that illustrates an example of the relationship between a temperature difference of coolant in a circulation flow passage before and after passage of the engine and a threshold.

FIG. 13 is a graph that illustrates an example of the relationship between the temperature difference ΔThe of coolant in the circulation flow passage 22 before and after flowing through the engine 10 and the threshold ΔThref. In the example shown in FIG. 13, the threshold ΔThref is set so as to tend to increase as a heat generation amount Qce of the engine 10 increases within the range larger than the above-described threshold ΔTh1 and smaller than or equal to the above-described threshold ΔTh2. This is based on the reason why, when the thermostat 40 is open, as the temperature difference ΔThe of coolant in the circulation flow passage 22 before and after flowing through the engine 10 increases (as the temperature of coolant after flowing through the engine 10 rises with respect to the temperature of coolant before flowing through the engine 10), the temperature difference ΔTh at the time when the selector valve 44 is normally open easily increases. As for the abscissa axis of FIG. 13, the temperature difference ΔThe of coolant in the circulation flow passage 22 before and after flowing through the engine 10 may be used, or a parameter related to the temperature difference ΔThe, such as the output power Pe of the engine 10, the ignition timing Ti of the engine 10, the rotation speed Nwp of the electric pump 32, and a water flow resistance Rw inside the engine 10 in the case where a mechanism of variably changing a water flow resistance inside the engine 10 in the circulation flow passage 22, may be used. It is presumable that the temperature difference ΔThe increases as the output power Pe of the engine 10 increases, increases as the ignition timing of the engine 10 is retarded, increases as the rotation speed Nwp of the electric pump 32 decreases and increases as the water flow resistance inside the engine 10 increases.

Figure 14:
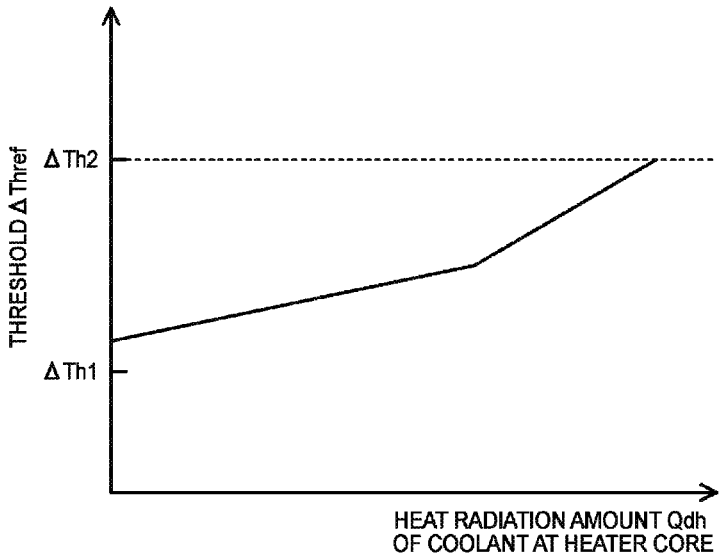
FIG. 14 is a graph that illustrates an example of the relationship between a heat radiation amount of coolant at a heater core in a bypass path and a threshold.

FIG. 14 is a graph that illustrates an example of the relationship between the heat radiation amount Qdh of coolant at the heater core 38 in the bypass flow passage 24 and the threshold ΔThref. In the example shown in FIG. 14, the threshold ΔThref is set so as to tend to increase as the heat radiation amount Qdh of coolant at the heater core 38 increases within the range larger than the above-described threshold ΔTh1 and smaller than or equal to the above-described threshold ΔTh2. This is based on the reason why, as the heat radiation amount Qdh of coolant at the heater core 38 increases, the temperature difference ΔTh at the time when the selector valve 44 is normally open easily increases. As for the abscissa axis of FIG. 14, the heat radiation amount Qdh of coolant at the heater core 38 in the bypass flow passage 24 may be used, or a parameter related to the heat radiation amount Qdh, such as whether a request to heat a vehicle cabin has been issued, and a set temperature at the time when a request to heat the vehicle cabin has been issued, may be used. It is presumable that the heat radiation amount Qdh is larger when the heating request has been issued than when the heating request has not been issued, and increases as the set temperature rises.

The correspondence relationship between the major elements of the above-described embodiment and the major elements of the present disclosure described in "SUMMARY" will be described. In the above-described embodiment, the circulation flow passage 22 corresponds to a first flow passage, the bypass flow passage 24 corresponds to a second flow passage, the communication flow passage 26 corresponds to a third flow passage, the thermostat 40 corresponds to a first valve, the selector valve 44 corresponds to a second valve, the coolant temperature sensor 50 corresponds to a first temperature sensor, the coolant temperature sensor 52 corresponds to a second temperature sensor, and the electronic control unit 60 corresponds to a determination unit.

The correspondence relationship between the major elements of the above-described embodiment and the major elements of the present disclosure described in "SUMMARY" does not limit the elements of the present disclosure described in "SUMMARY" because the above-described embodiment is an example for specifically illustrating the embodiment of the present disclosure described in "SUMMARY". That is, interpretation of the present disclosure described in "SUMMARY" should be made based on the description therein, and the above-described embodiment is only a specific example of the present disclosure described in "SUMMARY".

The embodiment of the present disclosure is described by the use of the embodiment and the alternative embodiments; however, the present disclosure is not limited to these embodiment and alternative embodiments. Of course, the present disclosure may be implemented in various forms without departing from the scope of the present disclosure. The present disclosure is usable in, for example, the industry of manufacturing a cooling system for an engine.

What is claimed is:

1. A cooling system for an engine, comprising:

a first flow passage configured to circulate a cooling medium through the engine and a radiator in this order;

a second flow passage configured to communicate the first flow passage upstream of the engine with the first flow passage downstream of the radiator;

a third flow passage configured to communicate the first flow passage between the engine and the radiator with the second flow passage;

a first valve configured to open or close to permit or restrict flow of the cooling medium, which has flowed through the radiator in the first flow passage, to the first flow passage downstream of a connection portion of the first flow passage with the second flow passage;

a second valve configured to open or close to permit or restrict flow of the cooling medium, which has flowed through the engine in the first flow passage, to the second flow passage via the third flow passage;

a first temperature sensor installed in the first flow passage between the engine and the radiator;

a second temperature sensor installed in the second flow passage downstream of a connection portion of the second flow passage with the third flow passage; and an electronic control unit configured to:

(i) while the second valve is being controlled so as to open, when a temperature difference between a first temperature detected by the first temperature sensor and a second temperature detected by the second temperature sensor is larger than or equal to a threshold, determine that there is a stuck-closed failure in the second valve, and (ii) set the threshold such that the threshold at the time when the first valve is open is larger than the threshold at the time when the first valve is closed.

2. The cooling system according to claim 1, wherein the first valve is a thermostat, and the electronic control unit is configured to estimate whether the thermostat is open or closed based on a comparison between the first temperature and a second threshold.

3. The cooling system according to claim 2, wherein the thermostat includes a built-in heater, and the electronic control unit is configured to reduce the second threshold as an energization current of the heater increases.

4. The cooling system according to claim 1, wherein the first valve is a control valve that is controlled by the electronic control unit to open or close, the electronic control unit is configured to control the control valve to open when the temperature of the cooling medium is equal to or higher than a predetermined value, and to control the control valve to close when the temperature of the cooling medium is lower than the predetermined value, and the electronic control unit is configured to set the threshold such that the threshold at the time when the control valve is being controlled so as to open is larger than the threshold at the time when the control valve is not being controlled so as to open.

5. The cooling system according to claim 1, wherein the electronic control unit is determine a presence or absence of a stuck-open failure in the first valve, the electronic control unit is configured to set the threshold such that the threshold at the time when there is the stuck-open failure in the first valve is larger than the threshold at the time when there is no stuck-open failure in the first valve and the first valve is closed.

6. The cooling system according to claim 1, wherein the first valve is a thermostat, and the electronic control unit is configured to estimate whether the thermostat is open or closed based on a comparison between a second temperature and a third threshold.

7. The cooling system according to claim 6, wherein the thermostat includes a built-in heater, and the electronic control unit is configured to reduce the third threshold as an energization current of the heater increases.

* * * * *